US009845767B2

(12) United States Patent
Quinton et al.

(10) Patent No.: US 9,845,767 B2
(45) Date of Patent: Dec. 19, 2017

(54) CAST DUAL WALL BULKHEAD WITH INTEGRAL OIL DRAIN

(71) Applicant: Cummins IP, Inc., Minneapolis, MN (US)

(72) Inventors: Aaron S. Quinton, Columbus, IN (US); John Jerl Purcell, Louisa, VA (US); Nathaniel Hassall, Thirsk (GB); Derek Ferguson, Columbus, IN (US)

(73) Assignee: Cummins IP, Inc., Minneapolis, MN (US)

( * ) Notice: Subject to any disclaimer, the term of this patent is extended or adjusted under 35 U.S.C. 154(b) by 126 days.

(21) Appl. No.: 14/647,220

(22) PCT Filed: Nov. 26, 2013

(86) PCT No.: PCT/US2013/071948
§ 371 (c)(1),
(2) Date: May 26, 2015

(87) PCT Pub. No.: WO2014/085425
PCT Pub. Date: Jun. 5, 2014

(65) Prior Publication Data

US 2015/0315996 A1 Nov. 5, 2015

Related U.S. Application Data

(60) Provisional application No. 61/730,650, filed on Nov. 28, 2012.

(51) Int. Cl.
*F02B 75/22* (2006.01)
*F01M 1/04* (2006.01)
(Continued)

(52) U.S. Cl.
CPC ..... *F02F 7/0021* (2013.01); *B22C 9/24* (2013.01); *B22D 25/02* (2013.01); *F02F 7/0007* (2013.01);
(Continued)

(58) Field of Classification Search
CPC ..... F02F 7/0021; F02F 7/0095; F02F 7/0068; F02F 7/0007; F02F 7/0065; B22C 9/24; B22D 25/02
(Continued)

(56) References Cited

U.S. PATENT DOCUMENTS 5,852,992 A * 12/1998 Boggs ..... F01M 11/02 123/196 CP
5,901,679 A 5/1999 Tanaka et al.
(Continued)

FOREIGN PATENT DOCUMENTS

CN 1804384 7/2006
CN 101089382 12/2007
(Continued)

OTHER PUBLICATIONS

The International Search Report and Written Opinion of the International Searching Authority issued in PCT/US2013/071948, dated Aug. 22, 2014.
(Continued)

*Primary Examiner* — Syed O Hasan
(74) *Attorney, Agent, or Firm* — Foley & Lardner LLP

(57) ABSTRACT

Systems and methods are provided for a cylinder block having one or more bulkheads. The bulkheads provide a dual-wall structure that may enhance the stiffness of the cylinder block in bending and torsion. The bulkheads may also provide an oil drain to allow oil to directly drain through a hollow core of the bulkhead. An overflow outlet may be formed in an inner wall of a bulkhead. In some implemen-
(Continued)

tations, a cylinder block with bulkheads may increase an oil capacity of an engine.

18 Claims, 12 Drawing Sheets

(51) Int. Cl.
*F02F 7/00* (2006.01)
*B22C 9/24* (2006.01)
*B22D 25/02* (2006.01)

(52) U.S. Cl.
CPC ..... *F02F 7/0065* (2013.01); *F02F 7/0068* (2013.01); *F02F 7/0095* (2013.01); *Y10T 29/49272* (2015.01)

(58) Field of Classification Search
USPC ..... 123/196 R, 195 R, 196 CP
See application file for complete search history.

(56) References Cited

U.S. PATENT DOCUMENTS

| | | | | |
|---|---|---|---|---|
| 6,571,763 | B1 | 6/2003 | Bakker | |
| 7,225,786 | B2 * | 6/2007 | Kim | B22C 9/103 123/195 R |
| 2004/0035376 | A1 | 2/2004 | Hoffmann et al. | |
| 2008/0006234 | A1 * | 1/2008 | Furukawa | F02F 7/0053 123/195 R |

FOREIGN PATENT DOCUMENTS

| | | |
|---|---|---|
| CN | 101956622 | 1/2011 |
| JP | 2004-084606 | 3/2004 |

OTHER PUBLICATIONS

The first office action issued in Chinese Patent Application No. 201380060302.1, dated Apr. 29, 2016.

* cited by examiner

CAST DUAL WALL BULKHEAD WITH INTEGRAL OIL DRAIN

CROSS REFERENCE TO RELATED APPLICATIONS

This application is a National Stage of PCT Application No. PCT/US2013/071948, filed Nov. 26, 2013, which claims priority to U.S. Provisional Appln. Ser. No. 61/730,650, filed Nov. 28, 2012, and entitled "Cast Dual Wall Bulkhead With Integral Oil Drain," the contents of which are hereby incorporated by reference in their entirety.

BACKGROUND

Deflection of a cylinder block of an engine is generally undesirable. Such deflection can contribute to undesirable vibrational modes and noise emission levels when the engine is running. Deflection of the cylinder block can also lead to manufacturing complications.

SUMMARY

Systems and methods are provided for a cylinder block having hollow bulkheads. The hollow bulkheads can provide hollow cores to enhance the stiffness of the cylinder block in bending and torsion. For example, the bulkheads can improve an axial deflection of the cylinder block, which is a variable determining the cylinder pressure limit for the cylinder block. In addition, the cylinder block described herein can provide an oil drain which allows oil to directly drain therethrough to, for example, an oil pan. Drawing the oil through the oil drain of the bulkheads straight into the oil pan can increase engine efficiency by precluding oil splashing at rotating and reciprocating components of the engine. Furthermore, the bulkheads can reduce material associated with making the cylinder block while improving engine efficiency.

In one implementation, a cylinder block may include an upper portion having a top deck. The top deck may include a first top bulkhead opening formed therethrough. The cylinder block may also include a lower portion having a recessed portion defining at least a portion of a crankcase. The lower portion may include a first bottom bulkhead opening. The cylinder block may further include a first bulkhead having a hollow core and in fluid communication with the first top bulkhead opening and the first bottom bulkhead opening to define a first oil drain. The first bulkhead may include a first overflow outlet formed in an inner wall of the first bulkhead.

In another embodiment, an engine may include a cylinder block. The cylinder block may include an upper portion having a top deck. The top deck may include a first top bulkhead opening formed therethrough. The cylinder block may also include a lower portion having a recessed portion defining at least a portion of a crankcase. The lower portion may include a first bottom bulkhead opening. The cylinder block may further include a first bulkhead having a hollow core and in fluid communication with the first top bulkhead opening and the first bottom bulkhead opening to define a first oil drain. The first bulkhead may include a first overflow outlet formed in an inner wall of the first bulkhead. The cylinder block may still further include a partial bulkhead having a hollow core and extending between a top end of the lower portion and a bottom end of the lower portion. The partial bulkhead may be in fluid communication with a second bottom bulkhead opening to define an overflow oil drain. The partial bulkhead may include a second overflow outlet formed in an inner wall of the partial bulkhead.

In a further implementation, a cylinder block may include an upper portion having a top deck. The top deck may include a plurality of top bulkhead openings formed therethrough. The cylinder block may also include a lower portion having a recessed portion defining at least a portion of a crankcase. The lower portion may include a plurality of bottom bulkhead openings. The cylinder block may further include a first set of bulkheads positioned relative to a first side of the cylinder block. The cylinder block also includes a second set of bulkheads positioned relative to a second side of the cylinder block. Each bulkhead of the first set of bulkheads and the second set of bulkheads may have a hollow core and may be in fluid communication with a respective top bulkhead opening of the plurality of top bulkhead openings and a respective bottom bulkhead opening of the plurality of bottom bulkhead openings to define an oil drain for each bulkhead. Each bulkhead of the first set of bulkheads and the second set of bulkheads may also include an overflow outlet formed in an inner wall of each bulkhead.

These implementations are mentioned not to limit or define the scope of this disclosure, but to provide examples of implementations to aid in understanding thereof.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

It will be recognized that some or all of the figures are schematic representations for purposes of illustration. The figures are provided for the purpose of illustrating one or more embodiments with the explicit understanding that they will not be used to limit the scope or the meaning of the claims.

DETAILED DESCRIPTION

Following below are more detailed descriptions of various concepts related to, and implementations of, methods, apparatuses, and systems for an engine having a dual wall bulkhead. The various concepts introduced above and discussed in greater detail below may be implemented in any of numerous ways as the described concepts are not limited to any particular manner of implementation. Examples of specific implementations and applications are provided primarily for illustrative purposes.

Generally, the implementations described herein describe a cylinder block that has one or more bulkheads having a dual-walled portion, which can serve as an oil drain and may also enhance the structural stiffness of the cylinder block.

Figure 1:
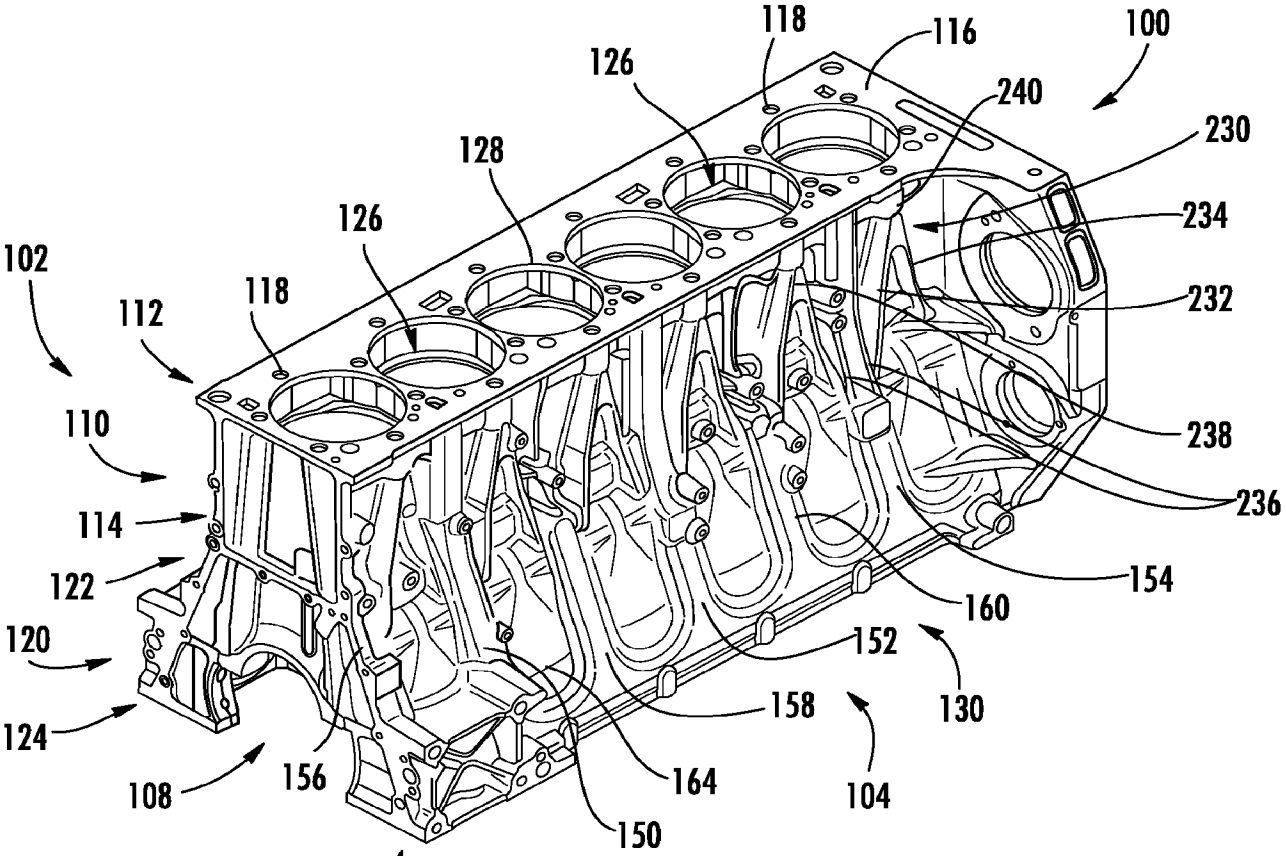
FIG. 1 is a perspective view of an example of a cylinder block having bulkheads that include a hollow portion through which oil may drain.

FIG. 1 depicts a perspective view of a cylinder block 100 according to an implementation described herein. The cylinder block 100 may be incorporated into an engine for a vehicle. FIGS. 2-5 depict bottom, top, front, and right views of the cylinder block 100 of FIG. 1, respectively. Referring generally to FIGS. 1-5, the cylinder block 100 has a body that includes an upper portion 110 and a lower portion 120. The upper portion 110 has a top end 112 and a bottom end 114. The lower portion 120 has a top end 122 and a bottom end 124. The bottom end 114 of the upper portion 110 and the top end 122 of the lower portion 120 may be integrally formed together to form a single homogeneous continuum of material, such as a one-piece construction. The cylinder block 100 may be one-piece body may be made of various materials, such as metal (e.g., steel, cast iron, aluminum, etc) or composite materials. The cylinder block 100 has an outer casing 130 shared by the upper portion 110 and the lower portion 120. Cylinders 126 are formed in the upper portion 110 of the cylinder block 100 to accommodate reciprocating pistons (not shown). The cylinder block 100 of the present example includes six cylinders 126 and openings 128, though it will be appreciated that the cylinder block 100 can include other numbers of cylinders, such as two, three, four, five, seven, eight, nine, ten, eleven, twelve, thirteen, fourteen, fifteen, sixteen, seventeen, eighteen, nineteen, twenty, twenty-one, twenty-two, twenty-three, twenty-four, etc. The cylinders 126 of the present example are aligned in an in-line configuration, though it will be appreciated that the arrangement of the cylinders 126 is not limited to an in-line configuration. For example, the cylinders 126 may be arranged in a V-configuration, in a radial configuration, or any other configuration.

The cylinder block 100 also includes a top deck 116 formed at the top end 112 of the upper portion 110 through which openings 128 for each cylinder 126 are defined. A cylinder head (not shown) may be mounted and coupled to the cylinder block 100 via attachment holes 118 (e.g., bolt holes) formed in the top end 112 of the upper portion 110 of the cylinder block 100 through the top deck 116. The attachment holes 118 may include threads to receive bolts or rods to connect the cylinder block 100 and the cylinder head together.

The lower portion 120 includes a bottom deck 106 formed at the bottom end 124 of the lower portion 120. The lower portion 120 further includes a recessed portion 108 that partially defines a crankcase. An oil pan (not shown) may be mounted and connected (e.g., via attachment holes) to the bottom end 124 of the lower portion 120 of the cylinder block 100, thereby forming the crankcase with the recessed portion 108. A crankshaft (not shown) may be disposed within the crankcase, which may be coupled, via a connecting rod, to a piston disposed within a cylinder 126. The crankshaft may include axially offset portions about which a first end portion of a connecting rod is connected. A second end portion of a connecting rod is connected to a piston disposed within a cylinder 126. As the crankshaft rotates, the axially offset portions of the crankshaft cause the piston to reciprocate within the cylinder 126.

Figure 2:
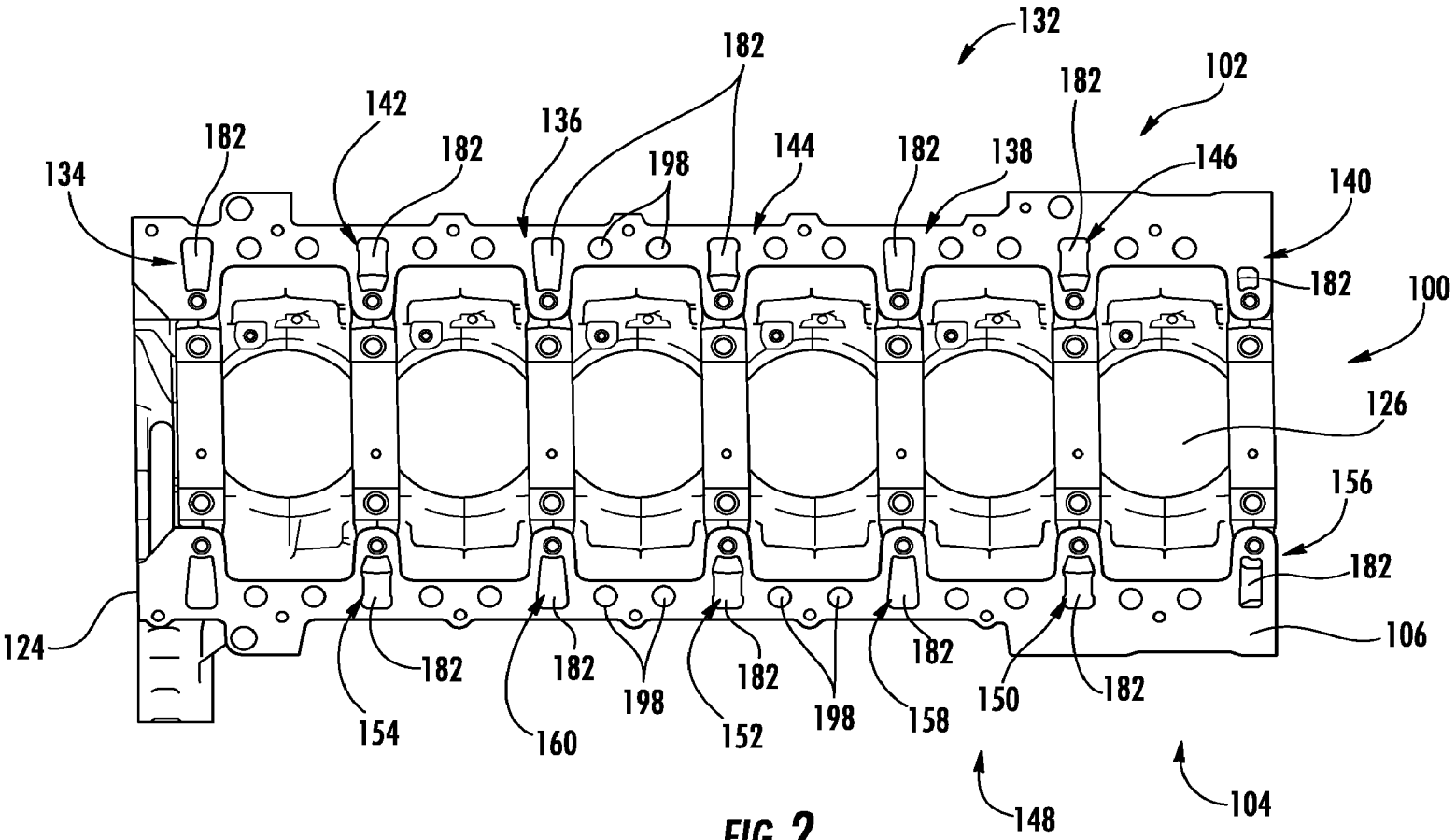
FIG. 2 is a bottom plan view of the cylinder block of FIG. 1.
Figure 3:
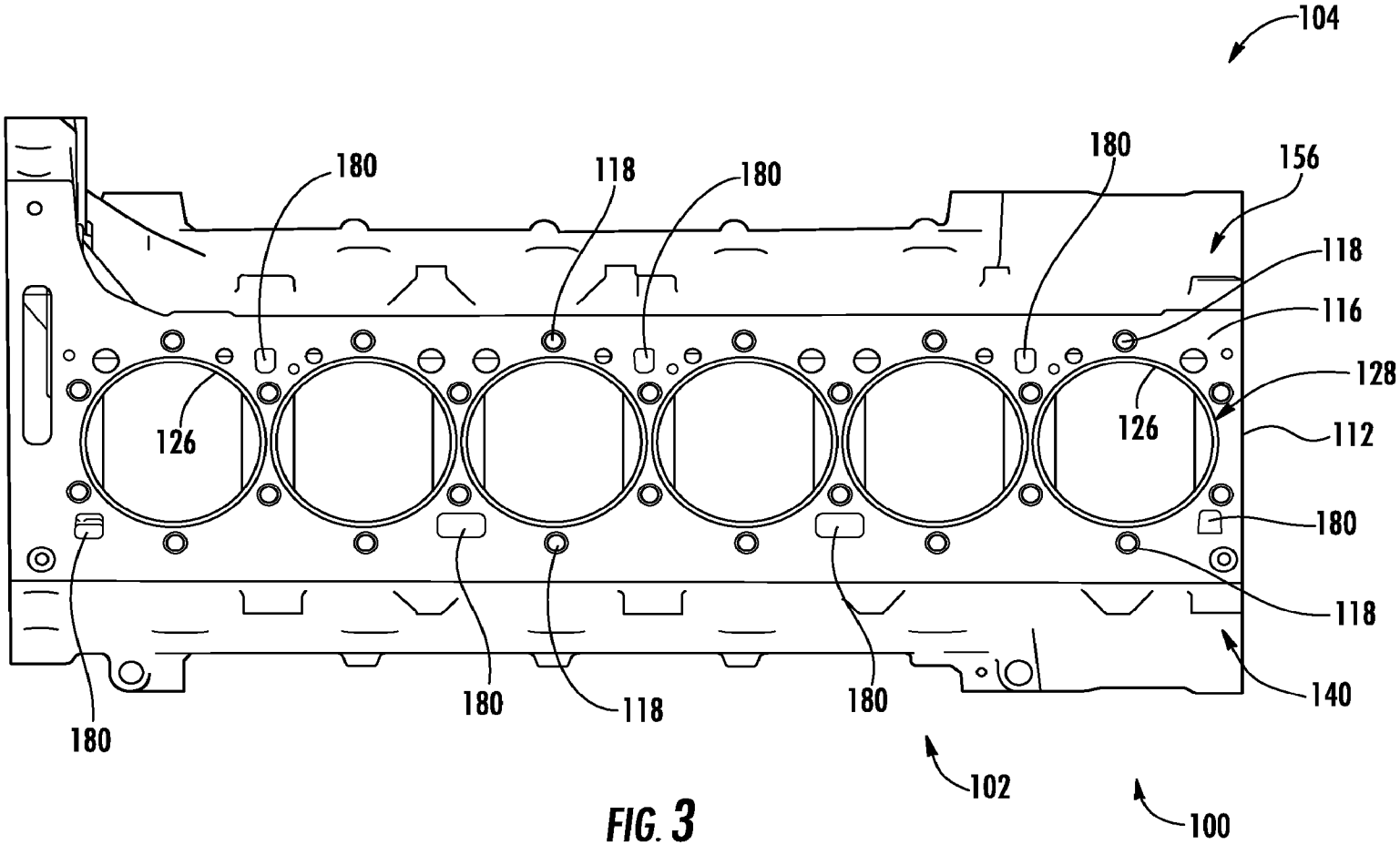
FIG. 3 is a top plan view of the cylinder block of FIG. 1.

The outer casing 130 of the cylinder block 100 includes a first side 102 and a second side 104, the second side 104 being opposite of the first side 102, as shown in FIGS. 2-3. A first set 132 of bulkheads may be formed on the first side 102 and a second set 148 of bulkheads may be formed on the second side 104. The first set 132 of bulkheads includes bulkheads 134, 136, 138, 140, 142, 144, 146 formed on the first side 102. Full bulkheads 134, 136, 138, 140, extend between the top end 112 of the upper portion 110 to the bottom end 124 of the lower portion 120 along the first side 102. In the present example, the full bulkheads 134, 136, 138, 140 substantially follow the outer contour of the first side 102, though this is merely an example. In other implementations, the full bulkheads 134, 136, 138, 140 may be substantially vertical, such as when formed internally within the first side 102.

The full bulkheads 134, 136, 138, 140 each have an inner wall 170, an outer wall 172, and a pair of side walls 174, 176, thereby defining a dual-walled structure that has a hollow core 178 (shown best in FIGS. 2, 7A-7C). The full bulkheads 134, 136, 138, 140 each extend up to the top deck 116 and include a top bulkhead opening 180 formed in the top deck 116. The full bulkheads 134, 136, 138, 140 also extend down to the a bottom deck 106 and include a bottom bulkhead opening 182 formed in the bottom deck 106. The dual-wall structure formed by the inner wall 170, the outer wall 172, and the side walls 174, 176 for the full bulkheads 134, 136, 138, 140 form an oil drain 200 extending therethrough. The outer wall 172 of the present example projects outside the first side 102 and the inner wall 170 projects into an inner side of the first side 102. The full bulkheads 134, 136, 138, 140 can have a generally tubular form that extends from the top end 112 to the bottom end 124 along the first side 102.

The oil drains 200 include top bulkhead openings 180 at the top end 112 of the upper portion 110 and bottom bulkhead openings 182 at the bottom end 124 of the lower portion 120 (see FIGS. 2-3). The oil drains 200 allow oil to drain through the cylinder block 100, from the top end 112 of the upper portion 110 to the bottom end 124 of the lower portion 120, and further to an oil pan (not shown) that may be mounted and connected to the lower portion 120 of the cylinder block 100. The bottom bulkhead openings 182 each have a trapezoidal shape which can enhance the stiffness of the cylinder block 100. In other implementations, the bottom bulkhead openings 182 may have other configurations. The top bulkhead openings 180 may have a rectangular shape, a square shape, a trapezoidal shape, and/or any other shape. In some implementations, the top bulkhead openings 180 may vary in size and/or shape depending upon the position of the top bulkhead opening 180.

The first set 132 of bulkheads for the cylinder block 100 further includes partial bulkheads 142, 144, 146. The partial bulkheads 142, 144, 146 extend from the top end 122 of the lower portion 120 to the bottom end 124 of the lower portion 120. In the present example, the partial bulkheads 142, 144, 146 substantially follow the outer contour of the lower portion 120 of the first side 102, though this is merely an example. In other implementations, the partial bulkheads 142, 144, 146 may be substantially vertical, such as when formed internally within the first side 102.

Similar to the full bulkheads 134, 136, 138, 140, the partial bulkheads 142, 144, 146 each have an inner wall 170, an outer wall 172, and a pair of side walls 174, 176, thereby defining a dual-walled structure that has a hollow core 178

(shown best in FIGS. 2, 7A-7C). The partial bulkheads 142, 144, 146 extend down to the a bottom deck 106 and include a bottom bulkhead opening 182 formed in the bottom deck 106. The partial bulkheads 142, 144, 146 extend up to the top end 122 of the lower portion 120. The dual-wall structure formed by the inner wall 170, the outer wall 172, and the side walls 174, 176 for the partial bulkheads 142, 144, 146 form an overflow oil drain 210 extending therethrough. The outer wall 172 of the present example projects outside the first side 102 and the inner wall 170 projects into an inner side of the first side 102. The partial bulkheads 142, 144, 146 can have a generally tubular form that extends from the top end 122 to the bottom end 124 along the lower portion 120 of the first side 102.

In some implementations, side openings 184 (shown best in FIG. 6) may be formed in the side walls 174, 176 of the bulkheads 134, 136, 138, 140, 142, 144, 146 such that fluid, such as oil, may flow into the recessed portion 108.

The first side 102 includes a side wall 162 that connects the side walls 174, 176 of the bulkheads 134, 136, 138, 140, 142, 144, 146 on the first side 102. In the implementation shown in FIGS. 2-3 and 5-7C, the full bulkheads 134, 136, 138, 140 and the partial bulkheads 142, 144, 146 are alternatingly disposed along the first side 102. It should be understood that, in some other implementations, the bulkheads 134, 136, 138, 140, 142, 144, 146 are not in an alternating arrangement and may be arranged in any other configuration.

Figure 6:
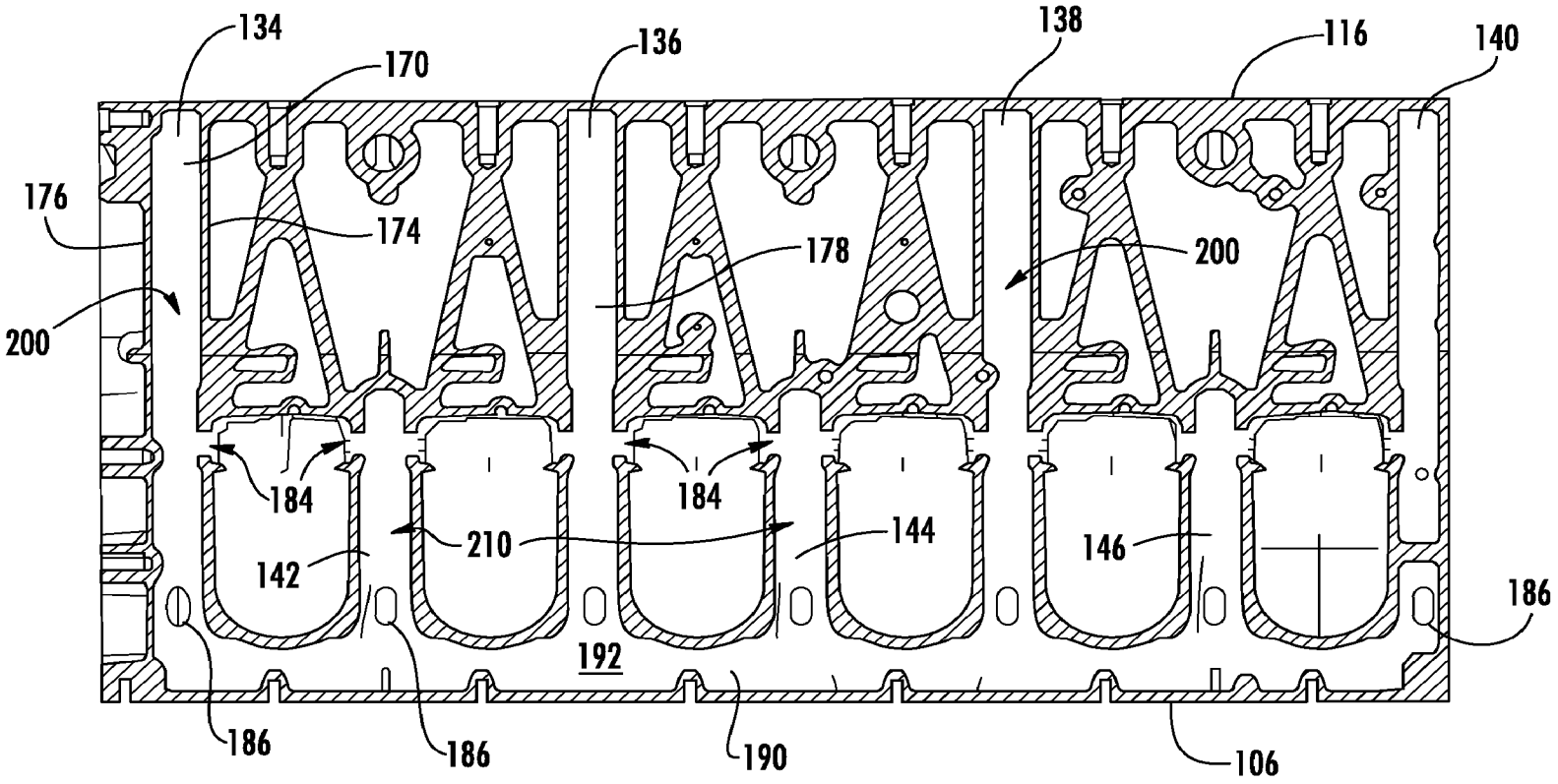
FIG. 6 is a sectional view of the cylinder block of FIG. 1 taken along line A-A in FIG. 4.

Referring to FIG. 6, a pan rail 190 fluidly connects the bulkheads 134, 136, 138, 140, 142, 144, 146 and extends longitudinally along the bottom end 124 of the lower portion 120 of the cylinder block 100 of the first side 102. The pan rail 190 includes a hollow core 192 that may be in fluid communication with the oil drains 200 and the overflow oil drains 210 defined by the bulkheads 134, 136, 138, 140, 142, 144, 146, respectively. The pan rail 190 further includes several pan rail openings 198 formed through the bottom deck 106, shown in FIG. 2. Thus, oil may flow through the bulkheads 134, 136, 138, 140, 142, 144, 146 and out through the bottom bulkhead openings 182 and/or the pan rail openings 198.

Figure 4:
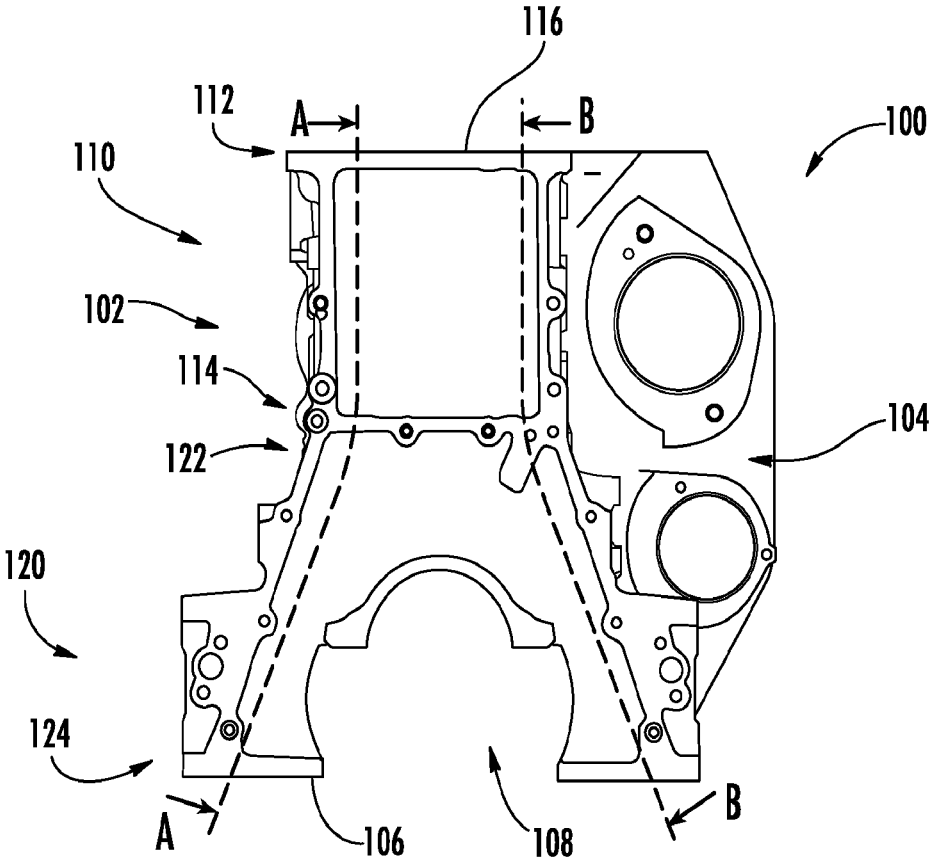
FIG. 4 is front elevation view of the cylinder block of FIG. 1.
Figure 5:
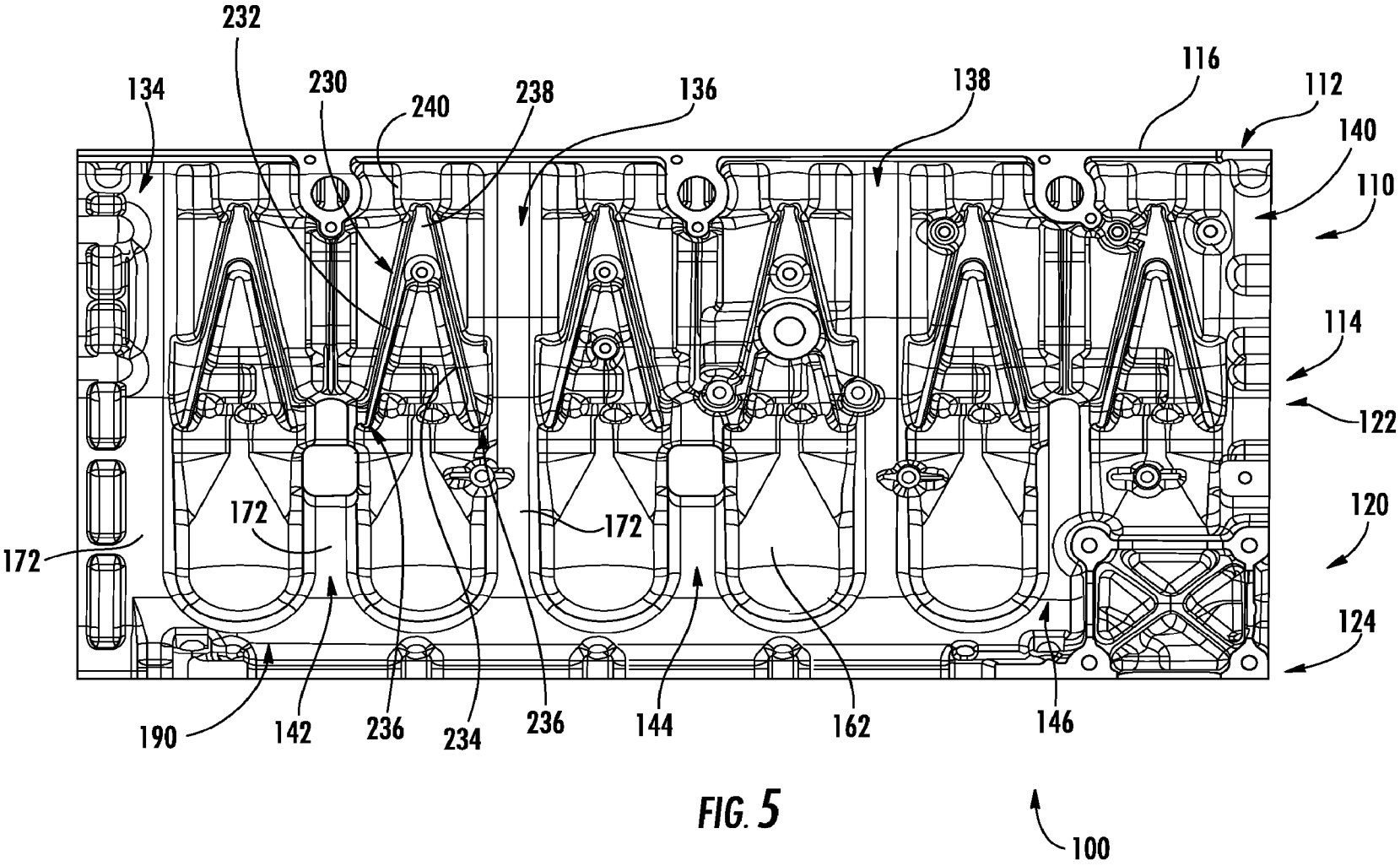
FIG. 5 is a left side elevation view of the cylinder block of FIG. 1.

The bulkheads 134, 136, 138, 140, 142, 144, 146 and the pan rail 190 formed on the first side 102 are shown best in FIG. 6 that is a sectional view as taken along line A-A of FIG. 4. In the implementation shown in FIG. 6, the bulkheads 134, 136, 138, 140, 142, 144, 146 each include an overflow outlet 186 formed through the inner wall 170. The overflow outlets 186 may direct oil to flow from the oil drains 200 and the overflow oil drains 210 into the crankcase via the recessed portion 108. A height of the overflow outlets 186 relative to openings 182, 198 may be varied to control an amount of additional oil capacity. That is, additional oil may be stored within the pan rail 190 and a portion of the full bulkheads 134, 136, 138, 140 and the partial bulkheads 142, 144, 146 up to the height of the overflow outlets 186, thereby increasing an oil capacity for an engine having the cylinder block 100.

Figure 7A:
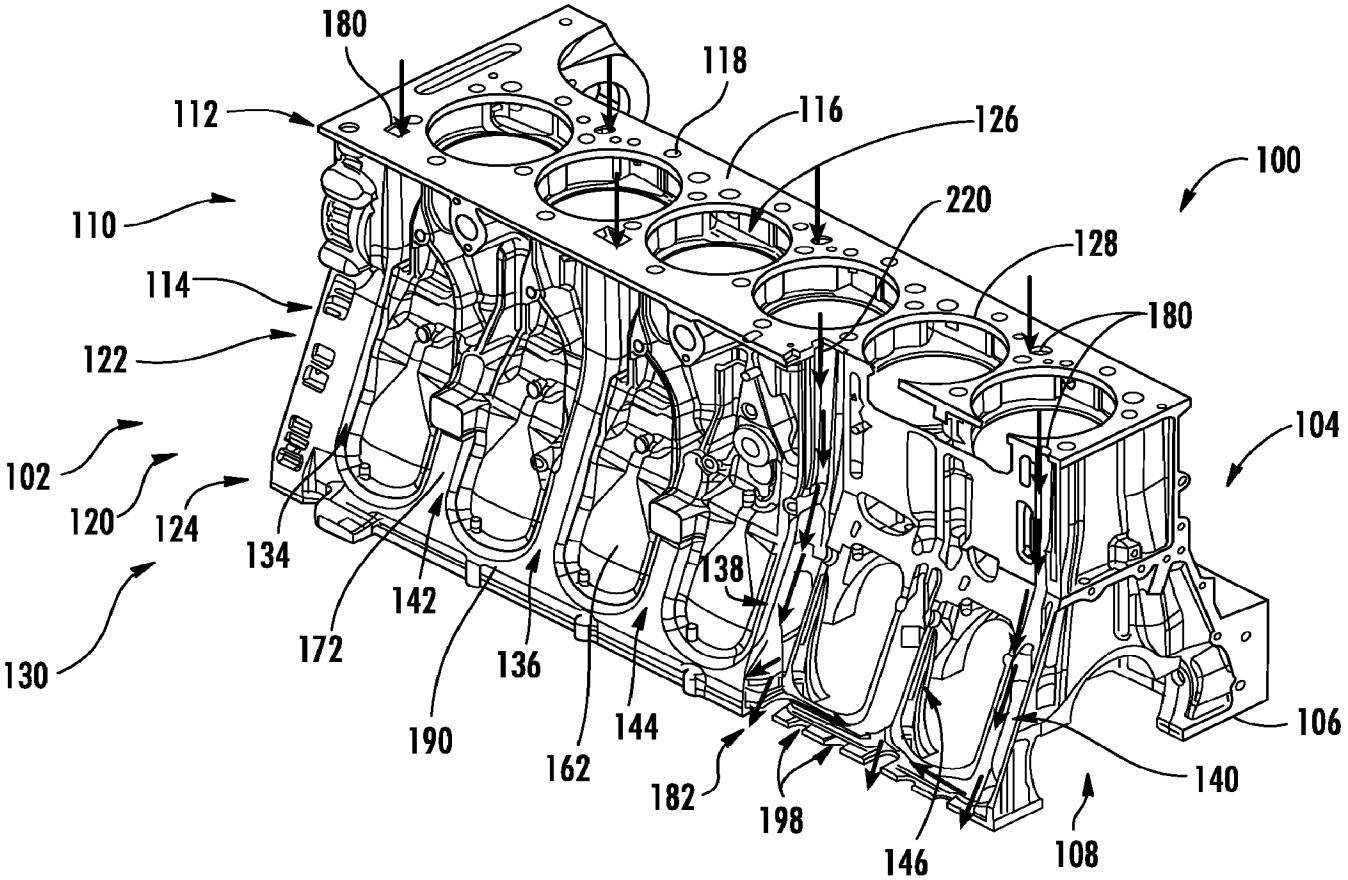
FIG. 7A is a perspective view of the cylinder block of FIG. 1 with a portion of a side of the cylinder block removed.
Figure 7B:
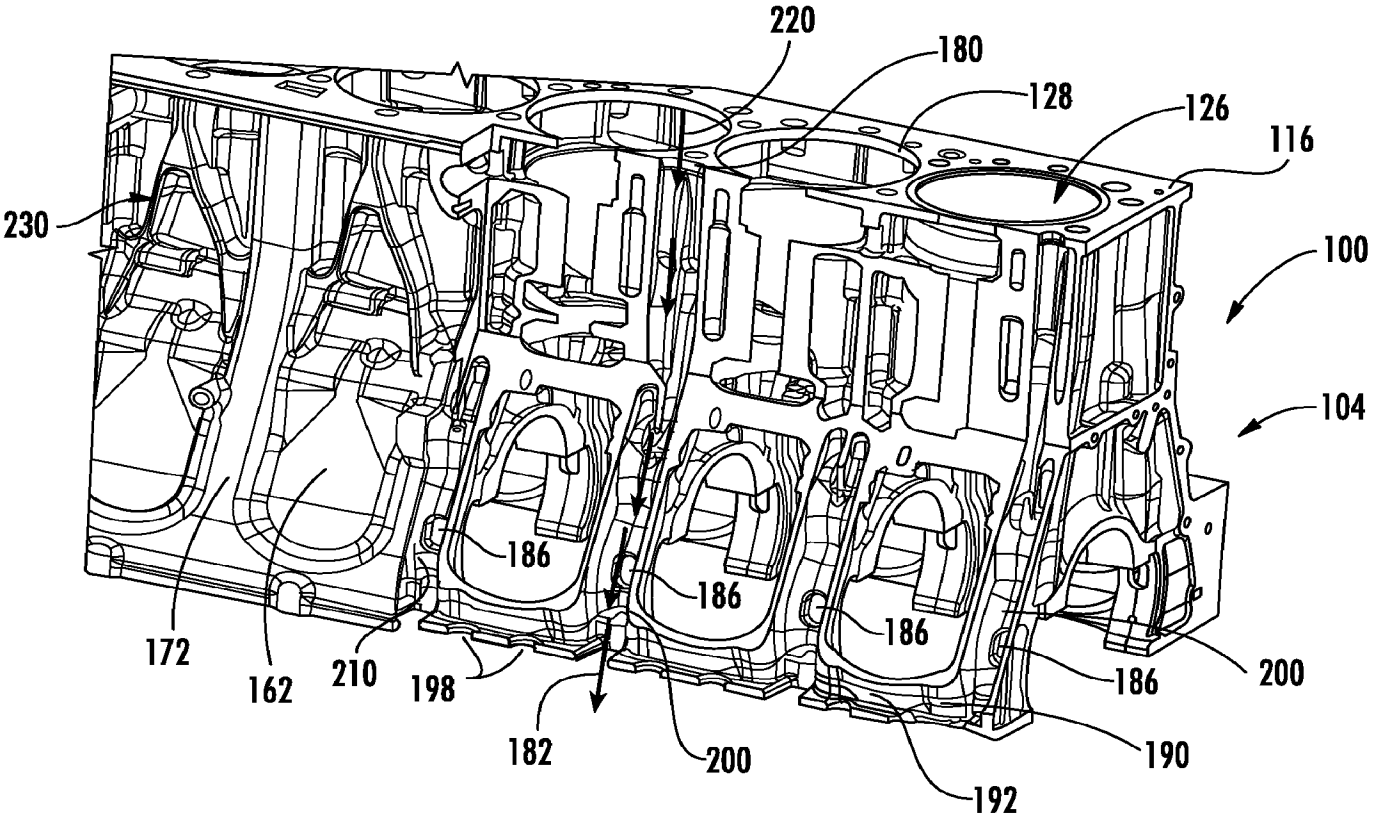
FIG. 7B is a partial enlarged view of the cylinder block of FIG. 6A.
Figure 7C:
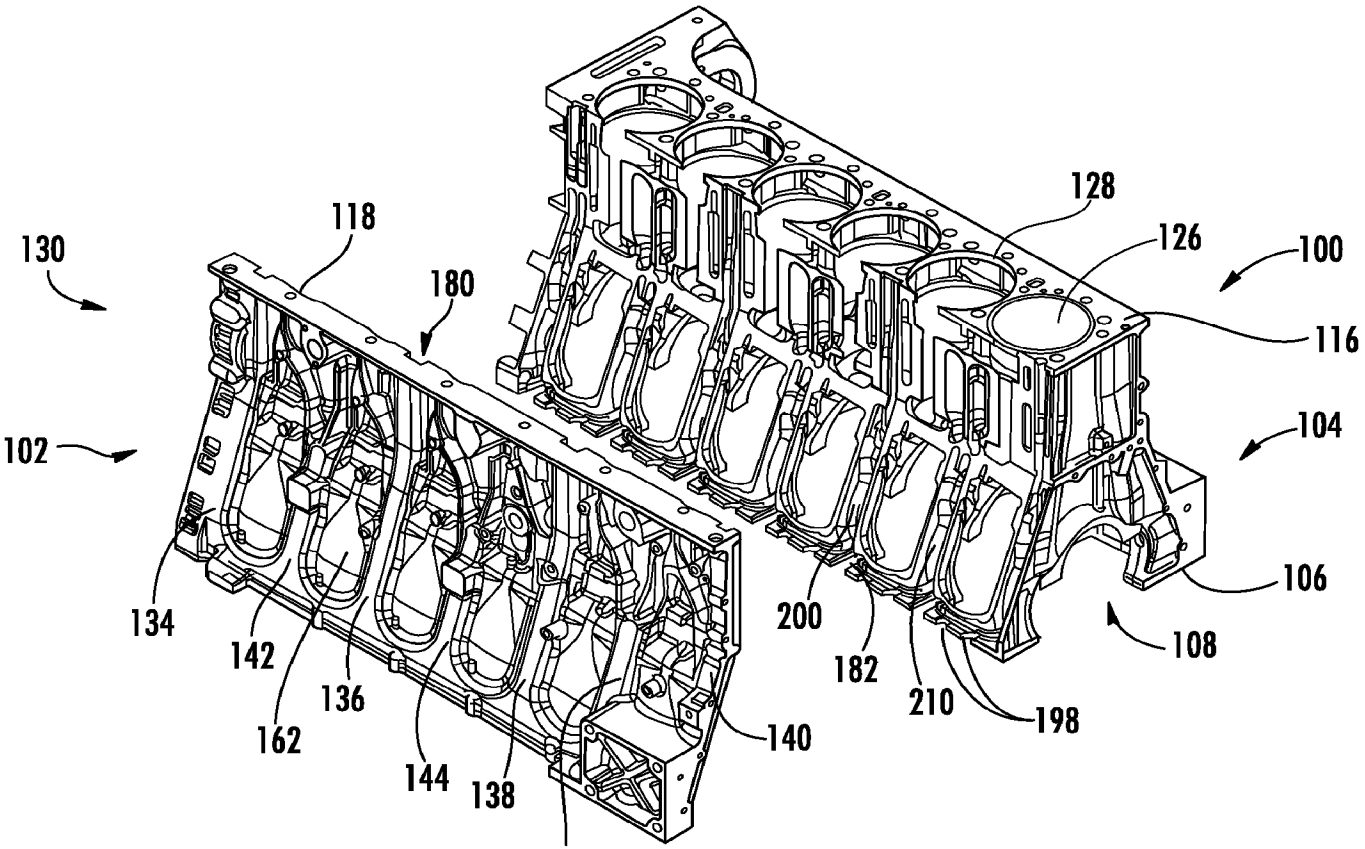
FIG. 7C is perspective view of the cylinder block of FIG. 1 shown with a portion of the side of the cylinder block cut away.

FIG. 7A is a perspective view of the cylinder block 100 depicted with a portion of the first side 102 of the cylinder block 100 removed, such as along the line A-A of FIG. 4. FIG. 7B is a partial enlargement of FIG. 7A. FIG. 7C is a perspective view of the cylinder block 100 depicted with a portion of the first side 102 of the cylinder block 100 shown cut away from the remainder of the cylinder block 100, such as along the line A-A of FIG. 4.

As shown in FIG. 7A, each of the full bulkheads 134, 136, 138, 140 on the first side 102 allows oil to drain through the cylinder block 100 along the flow path 220, from the top end 112 to the bottom end 124, and to an oil pan (not shown) via the oil drains 200 and bottom bulkhead openings 182. As shown in FIGS. 2 and 7A, the partial bulkheads 142, 144, 146 also include bottom bulkhead openings 182 at the bottom end 124 of the lower portion 120 such that any oil flowing through the pan rail 190 longitudinally along the lower portion 120 of the cylinder block 100 may also flow into an oil pan via bottom bulkhead openings 182.

It should be understood that the partial bulkheads 142, 144, 146 may omit a bottom bulkhead opening 182 such that the partial bulkheads 142, 144, 146 are closed at the bottom end 124 of the lower portion 120. As shown in FIG. 2, the pan rail 190 may include several pan rail openings 198 disposed between the bottom bulkhead opening 182 for assisting oil flow into an oil pan. It is to be understood that the number, size, and/or shape of the pan rail openings 198 may vary.

As noted above, the cylinder block 100 further includes a second set 148 of bulkheads formed on the second side 104. The second set 148 of bulkheads includes bulkheads 150, 152, 154, 156, 158, 160 formed on the second side 104. The bulkheads 150, 152, 154, 156, 158, 160 and a pan rail 190 formed on the second side 104 are shown best in FIG. 8 that is a sectional view as taken along line B-B of FIG. 4. Full bulkheads 150, 152, 154, extend between the top end 112 of the upper portion 110 to the bottom end 124 of the lower portion 120 along the second side 104. In the present example, the full bulkheads 150, 152, 154 substantially follow the outer contour of the second side 104, though this is merely an example. In other implementations, the full bulkheads 150, 152, 154 may be substantially vertical, such as when formed internally within the second side 104.

The full bulkheads 150, 152, 154 each have an inner wall 170, an outer wall 172, and a pair of side walls 174, 176, thereby defining a dual-walled structure that has a hollow core 178. The full bulkheads 150, 152, 154 each extend up to the top deck 116 and include a top bulkhead opening 180 formed in the top deck 116. The full bulkheads 150, 152, 154 also extend down to the a bottom deck 106 and include a bottom bulkhead opening 182 formed in the bottom deck 106. The dual-wall structure formed by the inner wall 170, the outer wall 172, and the side walls 174, 176 for the full bulkheads 150, 152, 154 form an oil drain 200 extending therethrough. The outer wall 172 of the present example projects outside the first side 102 and the inner wall 170 projects into an inner side of the second side 104. The full bulkheads 150, 152, 154 can have a generally tubular form that extends from the top end 112 to the bottom end 124 along the second side 104.

The oil drains 200 include top bulkhead openings 180 at the top end 112 of the upper portion 110 and bottom bulkhead openings 182 at the bottom end 124 of the lower portion 120 (see FIGS. 2-3). The oil drains 200 allow oil to drain through the cylinder block 100, from the top end 112 of the upper portion 110 to the bottom end 124 of the lower portion 120, and further to an oil pan (not shown) that may be mounted and connected to the lower portion 120 of the cylinder block 100. The bottom bulkhead openings 182 each have a trapezoidal shape which can enhance the stiffness of the cylinder block 100. In other implementations, the bottom bulkhead openings 182 may have other configurations. The top bulkhead openings 180 may have a rectangular shape, a square shape, a trapezoidal shape, and/or any other shape. In some implementations, the top bulkhead openings 180 may vary in size and/or shape depending upon the position of the top bulkhead opening 180.

The second set 148 of bulkheads for the cylinder block 100 further includes partial bulkheads 156, 158, 160. The partial bulkheads 156, 158, 160 extend from the top end 122 of the lower portion 120 to the bottom end 124 of the lower portion 120. In the present example, the partial bulkheads 156, 158, 160 substantially follow the outer contour of the lower portion 120 of the second side 104, though this is merely an example. In other implementations, the partial bulkheads 156, 158, 160 may be substantially vertical, such as when formed internally within the second side 104.

Similar to the full bulkheads 150, 152, 154, the partial bulkheads 156, 158, 160 each have an inner wall 170, an outer wall 172, and a pair of side walls 174, 176, thereby defining a dual-walled structure that has a hollow core 178. The partial bulkheads 156, 158, 160 extend down to the a bottom deck 106 and include a bottom bulkhead opening 182 formed in the bottom deck 106. The partial bulkheads 156, 158, 160 extend up to the top end 122 of the lower portion 120. The dual-wall structure formed by the inner wall 170, the outer wall 172, and the side walls 174, 176 for the partial bulkheads 156, 158, 160 form an overflow oil drain 210 extending therethrough. The outer wall 172 of the present example projects outside the first side 102 and the inner wall 170 projects into an inner side of the second side 104. The partial bulkheads 156, 158, 160 can have a generally tubular form that extends from the top end 122 to the bottom end 124 along the lower portion 120 of the second side 104.

In some implementations, side openings 184 may be formed in the side walls 174, 176 of the bulkheads 150, 152, 154, 156, 158, 160 such that fluid, such as oil, may flow into the recessed portion 108.

The second side 104 includes a side wall 164 that connects the side walls 174, 176 of the bulkheads 150, 152, 154, 156, 158, 160 on the second side 104. In the implementation shown, the full bulkheads 150, 152, 154 and the partial bulkheads 156, 158, 160 are alternatingly disposed along the second side 104. It should be understood that, in some other implementations, the bulkheads 150, 152, 154, 156, 158, 160 are not in an alternating arrangement and may be arranged in any other configuration.

Figure 8:
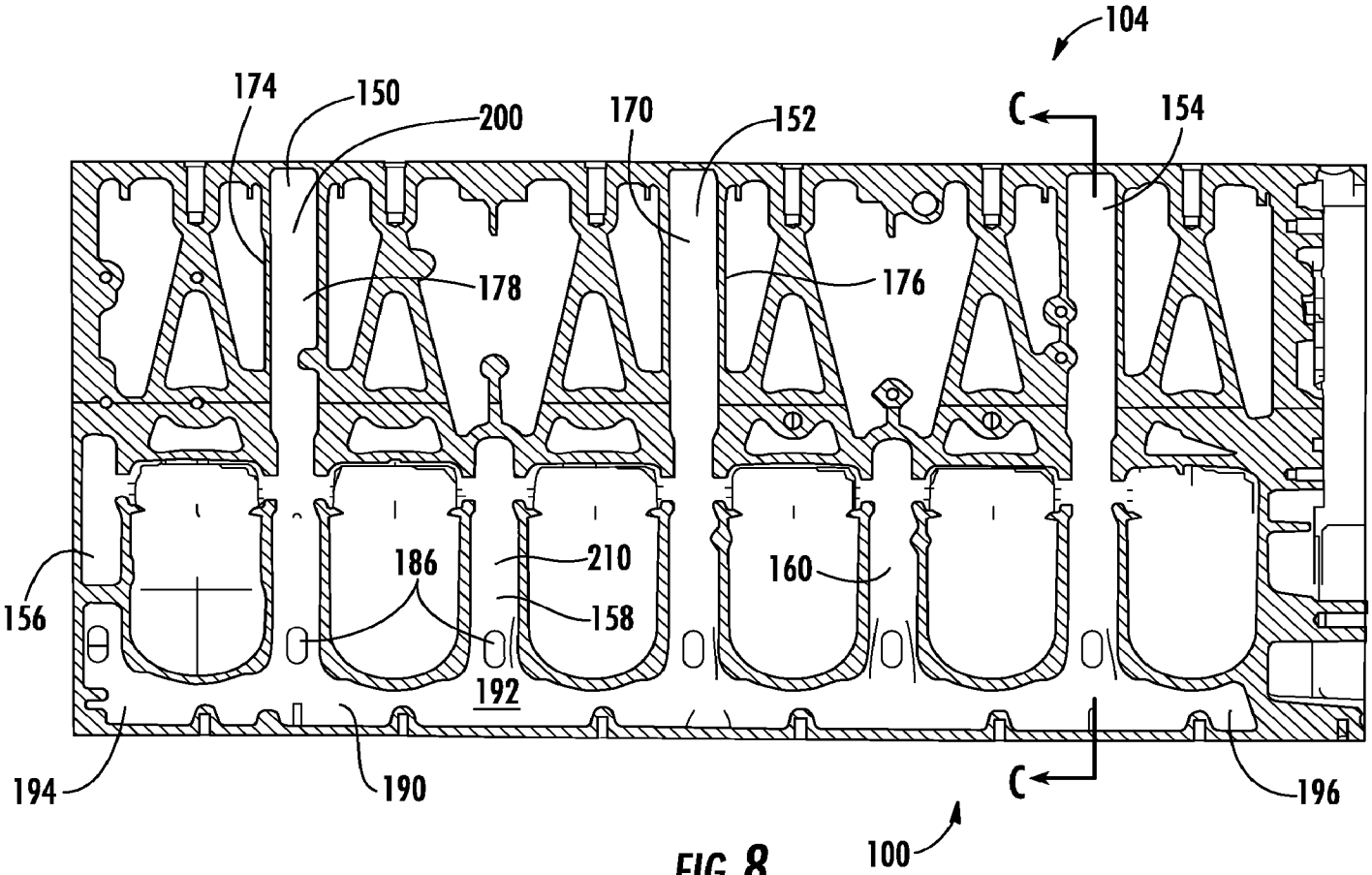
FIG. 8 is a sectional of the cylinder block of FIG. 1 taken along line B-B in FIG. 4.
Figure 9:
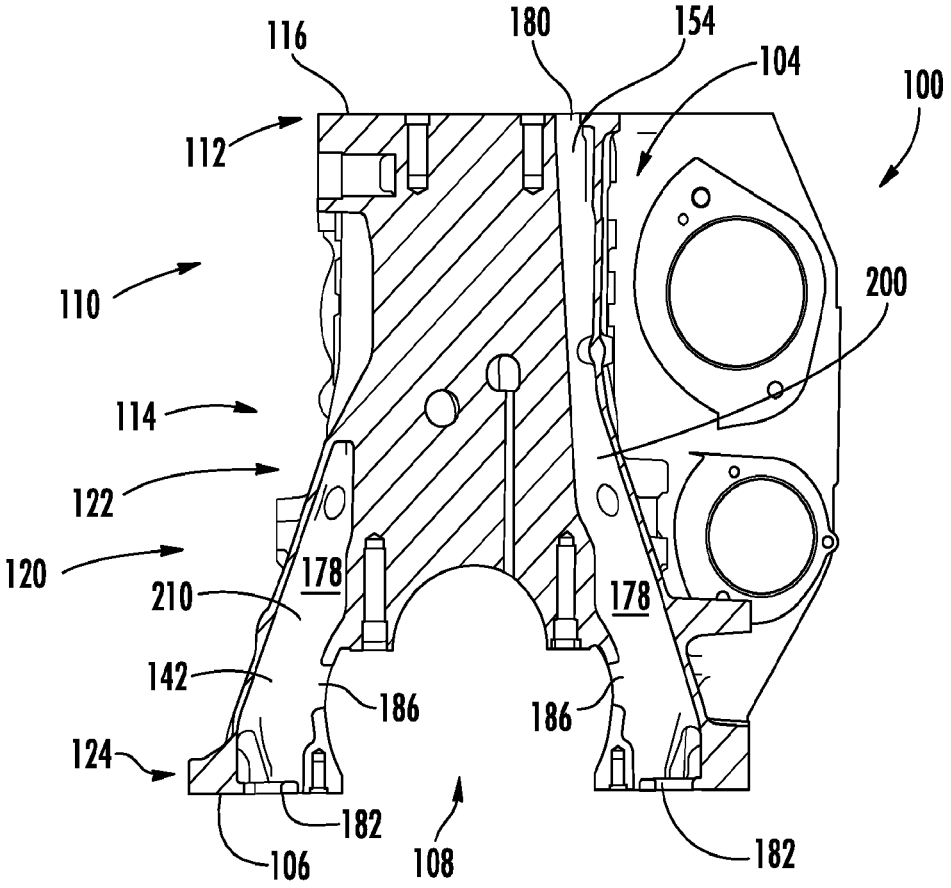
FIG. 9 is a rear elevation sectional view of the cylinder block of FIG. 1 taken along line C-C in FIG. 8.

Further still, as exemplified in FIGS. 3 and 9, the full bulkheads 154, 152, 150 of the second set 148 are arranged substantially opposite the partial bulkheads 142, 144, 146 of the first set 132. Similarly, the full bulkheads 140, 138, 136 of the first set 132 are arranged substantially opposite the partial bulkheads 156, 158, 160 of the second set 148. FIG. 9 is a rear elevation sectional view of the cylinder block 100 of FIG. 1 taken along line C-C in FIG. 8 and showing full bulkhead 154 of the second set 148 of bulkheads of the second side 104 and partial bulkhead 142 of the first set 132 of bulkheads of the first side 102. As shown in FIG. 9, the full bulkhead 154 is formed on the second side 104 and extends between the top end 112 of the upper portion 110 and the bottom end 124 of the lower portion 120. The partial bulkhead 142 is formed on the first side 102 and extends between the top end 122 of the lower portion 120 and the bottom end 124 of the lower portion 120. The full bulkhead 154 is positioned substantially opposite to the partial bulkhead 142 formed on the first side 102. It should be understood that the bulkheads 136, 138, 140, 142, 144, 146, 150, 152, 154, 156, 158, 160 may, in other implementations, not be positioned substantially opposite and may be arranged with respect to each other in any other configuration.

The pan rail 190 fluidly connects the bulkheads 150, 152, 154, 156, 158, 160 and extends longitudinally along the bottom end 124 of the lower portion 120 of the cylinder block 100 of the second side 104. The pan rail 190 includes a hollow core 192 that may be in fluid communication with the oil drains 200 and the overflow oil drains 210 defined by the bulkheads 150, 152, 154, 156, 158, 160, respectively. The pan rail 190 on the second side 104 further extends longitudinally along the lower portion 120 of the cylinder block 100 to form lateral hollow cores 194, 196. The pan rail 190 further includes several pan rail openings 198 formed through the bottom deck 106, shown in FIG. 2. Thus, oil may flow through the bulkheads 150, 152, 154, 156, 158, 160 and out through the bottom bulkhead openings 182 and/or the pan rail openings 198.

In the implementation shown in FIG. 8, the bulkheads 150, 152, 154, 156, 158, 160 each include an overflow outlet 186 formed through the inner wall 170. The overflow outlets 186 may direct oil to flow from the oil drains 200 and the overflow oil drains 210 into the crankcase via the recessed portion 108. A height of the overflow outlets 186 relative to openings 182, 198 may be varied to control an amount of additional oil capacity. That is, additional oil may be stored within the pan rail 190 and a portion of the full bulkheads 150, 152, 154 and the partial bulkheads 156, 158, 160 up to the height of the overflow outlets 186, thereby increasing an oil capacity for an engine having the cylinder block 100.

Similar to the bulkheads 134, 136, 138, 140, 142, 144, 146 depicted in FIG. 7A, each of the full bulkheads 150, 152, 154 on the second side 104 allows oil to drain through the cylinder block 100 along a flow path similar to the flow path 220 shown in FIGS. 7A-7B. Thus, oil may flow from the top end 112 to the bottom end 124, and to an oil pan (not shown) via the oil drains 200 and bottom bulkhead openings 182. The partial bulkheads 156, 158, 160 also include bottom bulkhead openings 182 at the bottom end 124 of the lower portion 120 such that any oil flowing through the pan rail 190 longitudinally along the lower portion 120 of the cylinder block 100 may also flow into an oil pan via bottom bulkhead openings 182.

It should be understood that the partial bulkheads 156, 158, 160 may omit a bottom bulkhead opening 182 such that the partial bulkheads 156, 158, 160 are closed at the bottom end 124 of the lower portion 120. As shown in FIG. 2, the pan rail 190 may include several pan rail openings 198 disposed between the bottom bulkhead opening 182 for assisting oil flow into an oil pan. It is to be understood that the number, size, and/or shape of the pan rail openings 198 may vary.

While in the implementation shown in FIGS. 1-9, the bulkheads are partially external-formed, e.g., the outer walls 172 extend outwardly relative to the side walls 162, 164, it will be appreciated that the bulkheads may be internal-formed, e.g., the outer walls 172 may be substantially aligned with each side wall 162, 164, respectively, to form a flat exterior surface.

In the implementation shown in FIGS. 1-9, the bulkheads 134, 136, 138, 140, 142, 144, 146, 150, 152, 154, 156, 158, 160 formed on the first side 102 and the second side 104, respectively, may be integrally formed with the first side 102 and the second side 104, respectively. The bulkheads 134, 136, 138, 140, 142, 144, 146, 150, 152, 154, 156, 158, 160 form a dual-wall structure as a portion of the first side 102 and the second side 104. The dual-wall structure includes an outer wall 172 and an inner wall 170 connected by side walls 174, 176. Compared to a conventional single-wall structure, such a dual-wall structure may enhance the stiffness of the cylinder block 100, for example, in bending and in torsion. The bulkheads 134, 136, 138, 140, 142, 144, 146, 150, 152, 154, 156, 158, 160 may improve the axial deflection of the cylinder block 100, which may be a variable in determining the cylinder pressure limit for a given cylinder block design.

In addition to the structural advantages, the bulkheads 134, 136, 138, 140, 150, 152, 154 include hollow cores 178 that define the oil drains 200, which can drain oil through the cylinder block 100 from the top end 112 to the bottom end 124 and may increase engine efficiency by precluding oil from splashing rotating and/or reciprocating components of the engine. The bulkheads 134, 136, 138, 140, 150, 152, 154 of the cylinder block 100 may collect the oil drained from the cylinder head and drain the oil back to an oil pan, a bedplate or a cast component. The rate of oil flow may be controlled by the openings 198, 182 formed in the bottom deck 106 at the bottom end 120. In addition, overflow outlets 186 formed through the inner walls 170 of the bulkheads 134, 136, 138, 140, 142, 144, 146, 150, 152, 154, 156, 158, 160 may further assist in draining oil to the oil pan, bedplate or cast component. In some implementations, oil may be stored in a lower portion of the bulkheads 134, 136, 138, 140, 142, 144, 146, 150, 152, 154, 156, 158, 160 and the pan rail 190 described herein up to the overflow outlets 186, thereby increasing oil capacity volume. The increase in oil capacity volume can be controlled by the height of the overflow outlets 186 relative to the bottom end 124 of the lower portion 120 through which the openings 198, 182 are formed. In addition, the openings 182, 198 and overflow outlets 186 described herein may be sized, shaped, and/or orificed to control oil drain rate. This may allow the oil capacity of the engine to be increased above a pan volume while, in some implementations, preventing the crankshaft from dipping into the stored oil during operation. Such an arrangement may extend service intervals for the engine by increasing the oil capacity.

In addition, the openings 182, 198 at the bottom end 120 and the overflow outlets 186 described herein may be located and/or positioned away from a crankshaft, which may reduce oil impingement. Further, oil may be quickly released through the overflow outlets 186 when, for example, the vehicle is on a gradient.

Referring back to FIGS. 1 and 5, the upper portion 110 of the cylinder block 100 further includes ribs 230 formed on the first side 102 and the second side 104. The ribs 230 are in an inverted "V" shape with a pair of legs 232, 234 each having a first end 236 connected to an adjacent bulkhead at the bottom end 124 of the upper portion 110 (e.g., via integral formation). A common end 238 of each rib 230 is connected to a bolt boss 240. The bolt bosses 240 of the present example are formed for attachment holes 118 that include threading such that a cylinder head (not shown) may be connected to the cylinder block 100. The ribs 230 can further improve the stiffness of the cylinder block 100. It should be understood that the ribs 230 may be omitted and/or the cylinder block 100 may include other reinforcement mechanisms.

Figure 10:
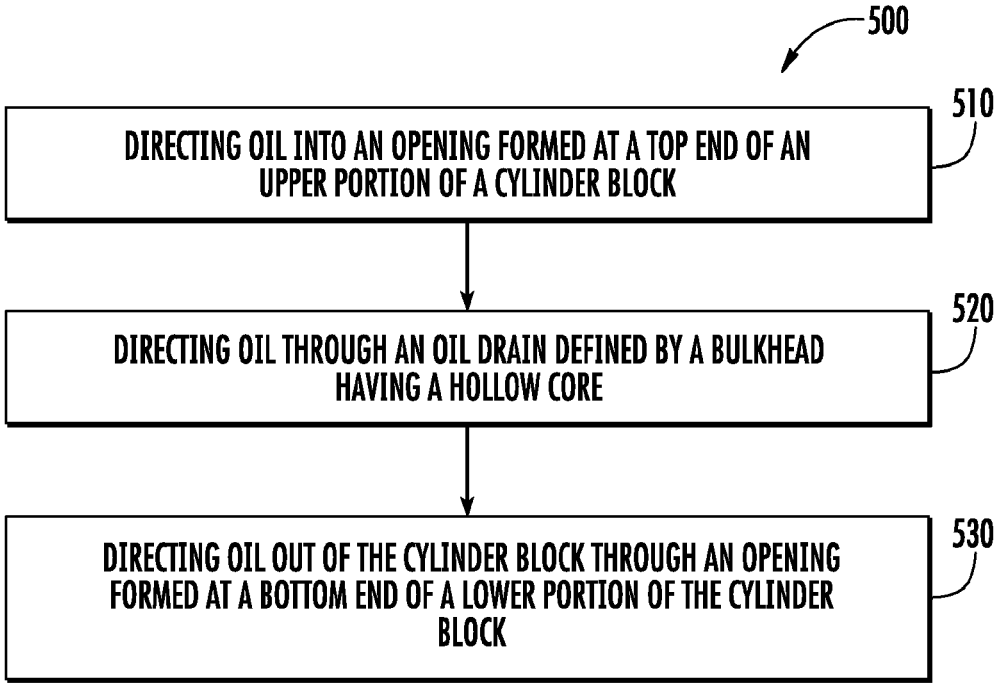
FIG. 10 is a flow diagram depicting an example process for draining oil through a cylinder block.

FIG. 10 illustrates a method 500 for draining oil through a cylinder block, such as the cylinder block 100 of FIGS. 1-9. At 510, oil is directed into an opening formed at a top end of a upper portion of the cylinder block. By way of example, the oil may be directed from, for example, a cylinder head mounted on the top deck 116 of the cylinder block 100 through top bulkhead openings 180 formed through the top deck 116. At 520, the oil is directed through an oil drain defined by a bulkhead having a hollow core. The oil may, for example, be directed through the oil drain 200 in the full bulkheads 134, 136, 138, 140, 150, 152, 154 formed on the sides 102, 104, respectively, of the cylinder block 100. The bulkheads 134, 136, 138, 140, 150, 152, 154 extend along a respective side 102, 104 from the top end 112 of the upper portion 102 to a bottom end 124 of a lower portion 120 of the cylinder block 100. At 530, the oil is directed out of the cylinder block through an opening formed at a bottom end of the lower portion of the cylinder block. The oil may be directed from the oil drains 200 out through a lower bulkhead opening 182 into an oil pan that is mounted to the lower portion 120 of the cylinder block 100. In the illustrated method 500, the oil can be directed through the oil drains 200 of the bulkheads 134, 136, 138, 140, 150, 152, 154. The oil may be directed out of the cylinder block 100 straight into an oil pan, which can increase engine efficiency by precluding the oil from splashing on the rotating and/or reciprocating components of the engine such as, for example, the pistons, the crankshaft, etc.

A method for creating the cylinder block 100 may include creating a mold for the cylinder block 100. The mold includes an upper mold portion defining an upper portion 110 of the cylinder block 100 and a lower mold portion defining a lower portion 120 of the cylinder block 100. In some implementations, the upper mold portion may define a rib 230 or several ribs 230 on an exterior surface of the upper portion 110 of the cylinder block 100. The mold further includes a bulkhead mold portion defining a hollow core 178 of a bulkhead (e.g., bulkheads 134, 136, 138, 140, 150, 152, 154) or several bulkheads extending between the upper portion 110 and the lower portion 120. The mold may further include a partial bulkhead mold portion defining a hollow core 178 of a partial bulkhead (e.g., bulkheads 142, 144, 146, 156, 158, 160) or several partial bulkheads extending between a top end 122 of the lower portion 120 and a bottom end 124 of the lower portion 120. The mold may also include a pan rail mold portion defining a hollow core 192 of a pan rail 190 or several pan rails. The pan rail mold portion may connect the bulkhead mold portion and the partial bulkhead mold portion. In some implementations, the mold may define one or more top bulkhead openings 180, bottom bulkhead openings 182, side openings 184, and/or overflow outlets 186. In some implementations, the mold may be a sand mold, such as that used in sand casting. In other implementations, other mold materials may be utilized.

The method for creating the cylinder block 100 may further include casting the cylinder block 100 using the mold. The casted cylinder block 100 includes the upper portion 110, the lower portion 120, and the bulkhead (e.g., bulkheads 134, 136, 138, 140, 150, 152, 154) or several bulkheads extending between the upper portion 110 and the lower portion 120. The casted cylinder block 100 may further include one or more partial bulkheads (e.g., bulkheads 142, 144, 146, 156, 158, 160) or several partial bulkheads extending between a top end 122 of the lower portion 120 and a bottom end 124 of the lower portion 120. The casted cylinder block 100 may also include a pan rail 190 or several pan rails. The pan rail 190 may connect one or more bulkheads with one or more partial bulkheads. In some implementations, the casted cylinder block 100 may include one or more top bulkhead openings 180, bottom bulkhead openings 182, side openings 184, and/or overflow outlets 186.

The method for creating the cylinder block 100 of the present example includes machining a top bulkhead opening 180 and an overflow outlet 186 in the casted cylinder block 100. In some implementations, a bottom bulkhead opening 182 and/or a side opening 184 may be machined into the cylinder block 100. The method for creating the cylinder block 100 may further include machining a top deck 116 for the upper portion 110 of the cylinder block 100 so that the top bulkhead opening 180 extends through the machined top deck 116. The machining may include drilling, boring, milling, lathing, jet machining, planing, grinding, broaching, etc.

It should be noted that references to "front," "back," "rear," "upward," "downward," "inner," "outer," "interior," "exterior," "right," and "left" in this description are merely used to identify the various elements as they are oriented in the FIGS. These terms are not intended to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

While this specification contains many specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

References to "or" may be construed as inclusive so that any terms described using "or" may indicate any of a single, more than one, and all of the described terms.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The claims should not be read as limited to the described order or elements unless stated to that effect. It should be understood that various changes in form and detail may be made by one of ordinary skill in the art without departing from the spirit and scope of the appended claims. All implementations that come within the spirit and scope of the following claims and equivalents thereto are claimed.

What is claimed is:

1. A cylinder block, comprising:

an upper portion having a top deck, the top deck including a first top bulkhead opening formed therethrough;

a lower portion having a recessed portion defining at least a portion of a crankcase, the lower portion including a first bottom bulkhead opening;

a first bulkhead having a hollow core and in fluid communication with the first top bulkhead opening and the first bottom bulkhead opening to define a first oil drain, the first bulkhead including a first overflow outlet formed in an inner wall of the first bulkhead, the first overflow outlet forming a fluid connection between the hollow core and the recessed portion of the lower portion defining the at least a portion of the crankcase; and a partial bulkhead having a hollow core and extending between a top end of the lower portion and a bottom end of the lower portion, the partial bulkhead being closed at the top end, the partial bulkhead in fluid communication with a second bottom bulkhead opening to define an overflow oil drain, the partial bulkhead including a second overflow outlet formed in an inner wall of the partial bulkhead.

2. The cylinder block of claim 1, further comprising:

a second bulkhead having a hollow core and in fluid communication with a second top bulkhead opening formed through the top deck and in fluid communication with a third bottom bulkhead opening to define a second oil drain;

wherein the partial bulkhead positioned between the first bulkhead and the second bulkhead.

3. The cylinder block of claim 1, wherein a height of the first overflow outlet and the second overflow outlet define, at least in part, an additional oil capacity.

4. The cylinder block of claim 1, further comprising:

a pan rail in fluid communication with the first bulkhead and the partial bulkhead.

5. The cylinder block of claim 4, wherein the pan rail includes a plurality of pan rail openings formed through the lower portion.

6. The cylinder block of claim 5, wherein a pan rail opening of the plurality of pan rail openings is positioned between the first bottom bulkhead opening and the second bottom bulkhead opening.

7. The cylinder block of claim 1, wherein the first bulkhead is formed on an outer surface of the upper portion and the lower portion.

8. The cylinder block of claim 1, wherein the first bulkhead is formed within the upper portion and the lower portion.

9. An engine comprising:

a cylinder block including:

an upper portion having a top deck, the top deck including a first top bulkhead opening formed therethrough, a lower portion having a recessed portion defining at least a portion of a crankcase, the lower portion including a first bottom bulkhead opening, a first bulkhead having a hollow core and in fluid communication with the first top bulkhead opening and the first bottom bulkhead opening to define a first oil drain, the first bulkhead including a first overflow outlet formed in an inner wall of the first bulkhead, the first overflow outlet forming a first fluid connection between the hollow core of the first bulkhead and the recessed portion of the lower portion defining the at least a portion of the crankcase, and a partial bulkhead having a hollow core and extending between a top end of the lower portion and a bottom end of the lower portion, the partial bulkhead being closed at the top end, the partial bulkhead in fluid communication with a second bottom bulkhead opening to define an overflow oil drain, the partial bulkhead including a second overflow outlet formed in an inner wall of the partial bulkhead, the second overflow outlet forming a second fluid connection between the hollow core of the partial bulkhead and the recessed portion of the lower portion defining the at least a portion of the crankcase.

10. The engine of claim 9, wherein a height of the first overflow outlet and the second overflow outlet define, at least in part, an additional oil capacity of the engine.

11. The engine of claim 9, wherein the cylinder block further comprises:

a second bulkhead having a hollow core and in fluid communication with a second top bulkhead opening formed through the top deck and in fluid communication with a third bottom bulkhead opening to define a second oil drain, wherein the partial bulkhead positioned between the first bulkhead and the second bulkhead.

12. The engine of claim 11, wherein the cylinder block further comprises:

a pan rail in fluid communication with the first bulkhead, the partial bulkhead, and the second bulkhead, the pan rail including a plurality of pan rail openings formed through the lower portion.

13. The engine of claim 12, wherein a pan rail opening of the plurality of pan rail openings is positioned between the first bottom bulkhead opening and the second bottom bulkhead opening.

14. The engine of claim 11, wherein the first bulkhead, the partial bulkhead, and the second bulkhead are formed on an outer surface of the upper portion and the lower portion.

15. The engine of claim 9, wherein the first bulkhead defines an oil flow path from the first top bulkhead opening to the first bottom bulkhead opening to substantially preclude oil flowing along the oil flow path from splashing rotating or reciprocating components of the engine.

16. A cylinder block comprising:

an upper portion having a top deck, the top deck including a plurality of top bulkhead openings formed therethrough;

a lower portion having a recessed portion defining at least a portion of a crankcase, the lower portion including a plurality of bottom bulkhead openings;

a first set of bulkheads positioned relative to a first side of the cylinder block;

a second set of bulkheads positioned relative to a second side of the cylinder block;

each bulkhead of the first set of bulkheads and the second set of bulkheads having a hollow core and in fluid communication with a respective top bulkhead opening of the plurality of top bulkhead openings and a respective bottom bulkhead opening of the plurality of bottom bulkhead openings to define an oil drain for each bulkhead, each bulkhead of the first set of bulkheads and the second set of bulkheads including an overflow outlet formed in an inner wall of the each bulkhead, each overflow outlet forming a fluid connection between a respective hollow core of a respective bulkhead and the recessed portion of the lower portion defining the at least a portion of the crankcase, and a partial bulkhead having a hollow core and extending between a top end of the lower portion and a bottom end of the lower portion, the partial bulkhead being closed at the top end, the partial bulkhead in fluid communication with a corresponding bottom bulkhead opening to define an overflow oil drain, the partial bulkhead positioned between a first bulkhead of the first set of bulkheads and a second bulkhead of the first set of bulkheads and substantially opposite a bulkhead of the second set of bulkheads.

17. The cylinder block of claim 16, wherein a height of the corresponding overflow outlet of the partial bulkhead and the overflow outlet of the each bulkhead of the first set of bulkheads and the second set of bulkheads define, at least in part, an additional oil capacity.

18. The cylinder block of claim 17, further comprising:

a first pan rail in fluid communication with the first set of bulkheads and the partial bulkhead; and a second pan rail in fluid communication with the second set of bulkheads.

* * * * *